United States Patent [19]

Evans et al.

[11] Patent Number: 4,802,602

[45] Date of Patent: Feb. 7, 1989

[54] INSULATING DEVICE FOR A BEVERAGE CONTAINER

[75] Inventors: John C. Evans, North Webster; Charles E. Campbell, Warsaw; John E. Blair, North Webster, all of Ind.

[73] Assignee: Kover-up, Inc., North Webster, Ind.

[21] Appl. No.: 130,071

[22] Filed: Dec. 8, 1987

[51] Int. Cl.[4] ..... B65D 23/08

[52] U.S. Cl. ..... 220/85 H; 224/148

[58] Field of Search ..... 220/85 H, 3.1, 94 R, 220/94 A, 96, 901; 224/148, 236, 240; 215/12.1, 13.1, 100.5; 150/52 R

[56] References Cited

U.S. PATENT DOCUMENTS

| | | | |
|---|---|---|---|
| 1,949,677 | 3/1934 | Crawford | 224/148 |
| 2,731,182 | 1/1956 | Higgins | 224/42.46 |
| 3,085,612 | 4/1963 | Gobel | 150/52 |
| 3,445,046 | 5/1969 | Wilson | 224/148 |
| 3,905,511 | 9/1975 | Groendal | 220/902 X |
| 4,197,890 | 4/1980 | Simko | 150/2.2 |
| 4,282,279 | 8/1981 | Strickland | 428/101 |
| 4,293,015 | 10/1981 | McGough | 150/52 R |
| 4,401,245 | 8/1983 | Zills | 224/148 |
| 4,478,265 | 10/1984 | DeMarco | 220/85 H |
| 4,479,596 | 10/1984 | Swanson | 224/240 X |
| 4,648,525 | 3/1981 | Henderson | 220/85 H |

*Primary Examiner*—Steven M. Pollard

*Attorney, Agent, or Firm*—Jeffers, Hoffman & Niewyk

[57] ABSTRACT

An insulating device for a beverage container including a flexible insulating sleeve for receiving a beverage container therein. A cover is provided for covering the top opening of the insulating device. A strap is provided to cover the bottom of the insulating device whereby the beverage container cannot pass through the insulating device. The cover is provided with two fastening devices whereby the cover may be secured over the beverage container or may be looped around to form a handle for the insulating device. A belt loop is also provided on the insulating device whereby the entire device may be secured to a belt.

8 Claims, 2 Drawing Sheets

INSULATING DEVICE FOR A BEVERAGE CONTAINER

BACKGROUND OF THE INVENTION

This invention relates to thermal insulating devices for beverages containers, and in particular, to a thermal insulating devices for use in connection with soft drink cans and the like. Such soft drink cans are standard in the beverage industry and are generally made of thin aluminum and have various opening arrangements such as flip tops and the like. Since soft drink beverages are generally cooled and the cans are made of a highly thermally conductive material such as aluminum, the cans generally tend to heat up quickly when placed in a warm ambient atmosphere, particularly if the cans are exposed to sunlight. Therefore, in the past, devices have been provided to insulate such beverage containers and keep them cool. These prior art devices have generally been open ended cylindrical containers into which the beverage containers could be placed. The devices were generally made of an insulating material such as styrofoam or the like, which material is rather soft and is easily deformed.

A disadvantage of these prior art devices has been that no means has been provided to close a beverage container once it has been opened. Therefore if the beverage container is left unattended, insects, dust and other foreign matter could easily enter the beverage container. This is not only unpleasant and necessitates disposal of the remainder of the beverage, but can also be dangerous because insects, such as bees or wasps, are often attracted to sweetened beverages and thereby could cause severe injury and even death if the user ingested an insect which had entered the beverage container.

Furthermore, since the top of the beverage container is not covered with an insulating material, insulation of beverage containers by such prior art insulating devices was not as effective as desired. Also, since these prior art insulating devices comprised open ended cylinders, any spillage from the beverage containers is retained in the insulating device, which is undesirable.

Still further, since, in order to provide a substantial amount of insulation, the walls of the prior art insulating devices were rather thick, the devices were rather hard to hold in one hand for many individuals. Also such prior art devices could not be attached to a person's belt so that the user had to continually carry such a prior art device or set it down, both of which may be undesirable.

Yet further, since the prior art devices were rather bulky, they created storage problems, particularly in confined spaces such as in boats, cars and the like.

Yet another disadvantage of the prior art styrofoam insulating devices was that, after continued use, the styrofoam would be sufficiently deformed so that the container would not grip the beverage container tightly, thereby causing reduced insulating effectiveness of the prior art insulating devices.

SUMMARY OF THE INVENTION

The present invention overcomes the disadvantages of the above prior art beverage container insulating devices by providing an improved insulating device therefor.

The insulating device of the present invention, in one form thereof, provides a flexible insulating sleeve adapted to receive a beverage container therein. A strap is provided over the bottom aperture of the sleeve to prevent beverage containers from falling out of the sleeve. A flexible insulating cover is secured to the sleeve and is adapted to cover the other aperture of the sleeve after the beverage container is inserted into the sleeve. The flexible cover includes fastening means which cooperates with the sleeve whereby the cover may be secured in place. The cover also includes further fastening means whereby the cover may be used as a handle by looping the cover and securing the other end thereof to the sleeve. The device is also provided with a belt loop. Lastly, the cover forms a closeable pocket.

One advantage of the device according to the present invention is that the cover prevents insects and other foreign matter from entering an opened beverage container. A further advantage of the device is that the cover insulates the top of the beverage container, thereby providing improved insulation of the beverage container.

Another advantage of the device according to the present invention is that the belt loop enables the entire insulating device to be secured to a person's belt thereby allowing the person free use of his hands without the necessity of holding onto the beverage container insulating device.

Still another advantage of the present invention is that the device can be used as a wallet. It should also be noted that the device can float which is particularly advantageous in boating and fishing activities.

Still a further advantage of the present invention is that the cover of the insulating device converts into a handle thereby making it easy to hold onto the beverage container insulating device, particularly for persons with small hands.

Yet another advantage of the present invention is that the end strap which is secured across the bottom aperture of the insulating sleeve ensures that the insulating device and beverage container have a more stable base than was provided in prior art devices whereby the device is less likely to tip over.

Yet still another advantage of the device according to the present invention is that it is flexible, can be easily stored and takes up very little space. Several of the devices may be fastened together with the loop and hook (Velcro) material in accordion fashion.

Still another further advantage of the device according to the present invention is that beverage spillage is not retained in the sleeve because the sleeve is bottomless.

A further advantage of the present invention is that a cigarette pack may be stored in the cylinder and a lighter in the wallet pocket, thereby enabling golfers, gardeners and the like to carry cigarettes on their belts, particularly if no other pockets on their clothing are available.

A yet still further advantage of the device according to the present invention is that the stretchable insulating sleeve fits more tightly around a beverage container than was true of the prior art insulating devices and therefore insulates beverage containers better than did the prior art devices and can hold variously shaped beverage containers.

The present invention, in one form thereof, comprises a device for insulating a beverage container and includes an insulating sleeve adapted to receive a beverage container therein. A flexible cover is provided which has one end thereof secured to the sleeve and which is adapted to cover the end aperture of the sleeve.

The present invention, in one form thereof, further provides a device for insulating a beverage container. The device includes a flexible insulating sleeve which is adapted to receive a beverage container therein. A strap is secured across the first aperture of the sleeve to prevent the beverage container from passing through the first aperture. A flexible cover is provided for covering the other end aperture of the sleeve. The cover has one end thereof secured to the sleeve. A fastening device cooperates with the other end of the cover to secure the cover over the other sleeve end aperture.

The present invention, in one form thereof, still further provides a device for insulating a beverage container. The device includes a flexible insulating sleeve adapted to receive a beverage container therein. A flexible insulating cover is provided to cover the other end aperture of the sleeve. The cover has one end thereof secured to the sleeve. Means is provided for the first end aperture of the sleeve to prevent a beverage container from passing through the first aperture. A first fastening means is operatively associated with the other end of the cover for securing the cover over the other sleeve end aperture. A second fastening means is operatively associated with the other end of the cover to secure the cover other end to the sleeve to form a handle.

It is an object of the present invention to provide an insulating device for a beverage container to prevent insects or foreign matter from entering an open beverage container. Another object of the present invention is to provide a beverage container insulating device which includes a cover for covering the top of the beverage container. A further object of the present invention is to provide a beverage container insulating device wherein the cover can be converted into a handle. Yet another object of the present invention is to provide an insulating device for a beverage container which will be able to insulate beverage containers of various shapes and sizes. A yet further object of the present invention is to provide an insulating device for a beverage container which is easy to store. A still further object of the present invention is to provide a flexible floatable insulating device for beverage containers. A yet still further object of the present invention is to provide a beverage container insulating device which includes a belt loop. Yet still another object of the present invention is to provide a beverage container insulating device which more effectively insulates beverage containers.

An additional object of the present invention is to provide a beverage container insulating device wherein spillage from the beverage container is permitted to run off without being retained in the insulating device.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Referring to FIGS. 1–5, the insulating device according to the present invention is illustrated. The device includes a sleeve 10 made of a flexible material such as for instance a Tricot warpknit textile material. The material preferably floats so that the entire device will float. The sleeve is formed with a top aperture 12 and a bottom aperture 14. Stitching 16 and 18 is provided at the top and bottom, respectively, of the sleeve. Thus the sleeve is open so that a beverage container may be inserted into opening 20 thereof whereby the sleeve insulates the sides of the beverage container.

Figure 2:
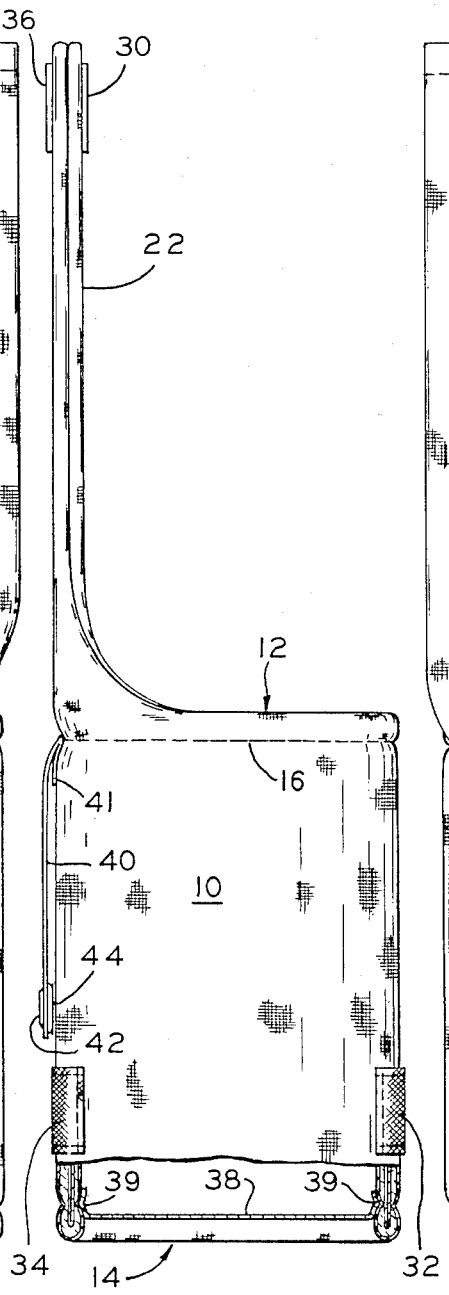
FIG. 2 is a side elevational view of the device of FIG. 1 taken from the left hand side thereof.
Figure 3:
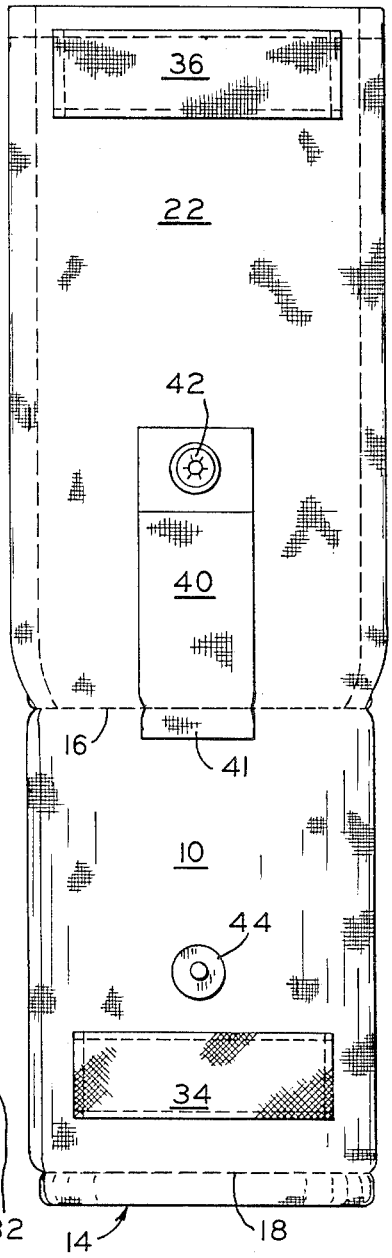
FIG. 3 is a rear elevational view of the device of FIG. 1.
Figure 4:
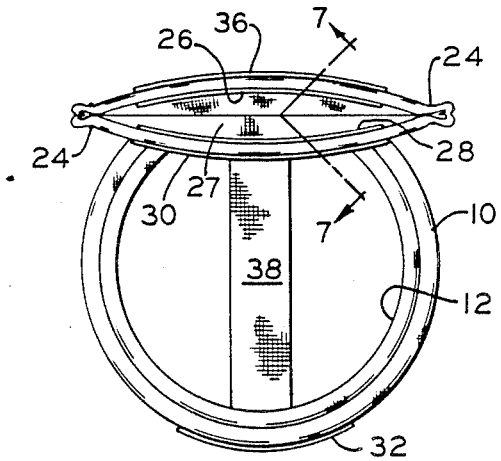
FIG. 4 is a top plan view of the device of in FIG. 1.

A cover 22 is secured to the sleeve such as by stitching or may be formed integrally with the sleeve as shown in the preferred embodiment illustrated in FIGS. 1–5. Sleeve 10 in the embodiment here illustrated, is formed of two flaps of material which are stitched together by means of stitching 24. The one end of cover 22 is secured directly to sleeve 10 whereas the other end of cover 22 is left open as best shown in FIG. 4 to form an opening 27. Thus, the cover forms a pocket. The pocket may be closed by means of a hook and loop material, commonly called Velcro material, whereby the cover may be used as a wallet to be used, for instance, for holding change. It should be noted that objects other than beverage cans, for instance, cigarettes, may be stored in the sleeve and a lighter in the pocket.

Figure 1:
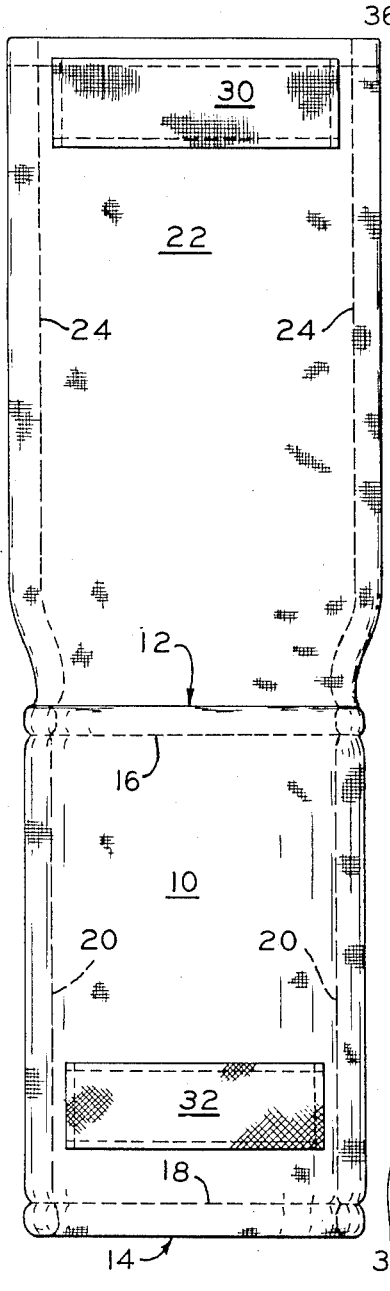
FIG. 1 is a front view of the insulating device according to the present invention with the cover disposed upwardly.
Figure 9:
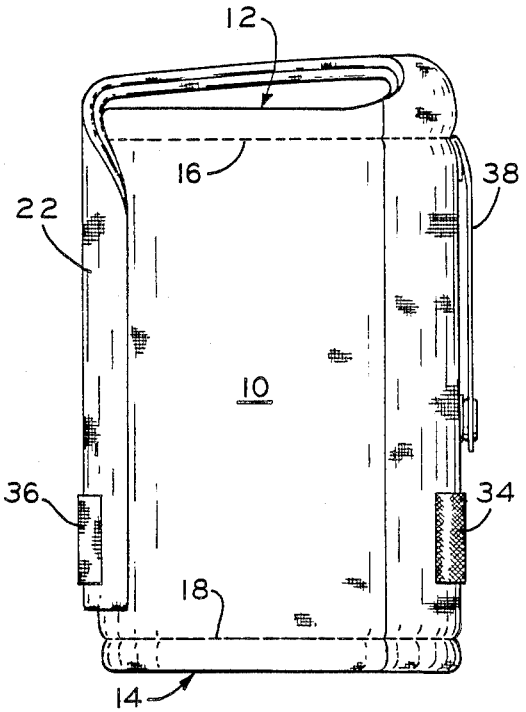
FIG. 9 is a side elevational view of the device of FIG. 1 taken from the right hand side thereof with the cover arranged to cover the top opening of the device.

As seen in FIG. 1, patches of hook and loop material 30 and 32 are provided whereby the cover may be secured over the top aperture 12 of the sleeve as best shown in FIG. 9. In this position, the cover will insulate the top of the beverage container whereas the sides of the beverage container are insulated by sleeve 10.

Figure 8:
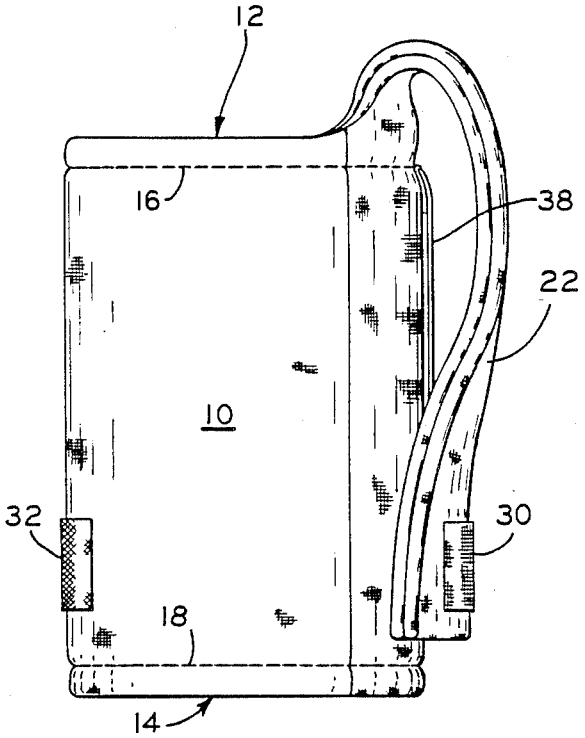
FIG. 8 is a side elevational view of the device of FIG. 1 taken from the right hand side thereof with the cover arranged as a handle.

As seen in FIG. 3, cover 22 and sleeve 10 further include hook and loop patches 34 and 36 whereby cover 22 may be arranged as a handle as best shown in FIG. 8. Thus, after insertion of a beverage container into sleeve 10, cover 22 may be used to carry the entire device including the beverage container.

A bottom strap 38 is secured to the inside of opening 20 by means of stitching 39 as best shown in FIG. 2.

Figure 6:
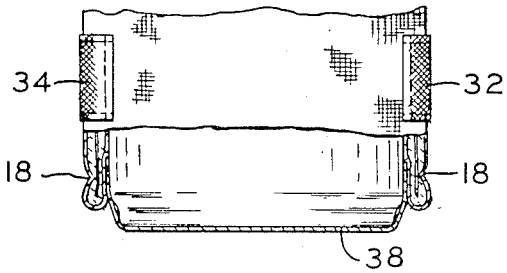
FIG. 6 is a partial, broken away, elevational view of the bottom portion of the device of FIG. 1 with a beverage container inserted therein.
Figure 5:
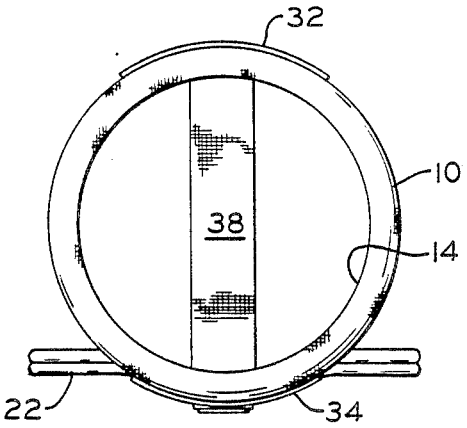
FIG. 5 is a bottom plan view of the device of FIG. 1.
Figure 7:
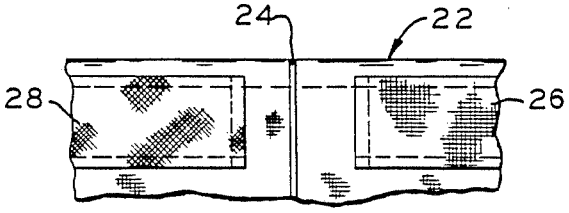
FIG. 7 is a broken away, sectional, view taken along line 7—7 of FIG. 4 with the cover opened.

This bottom strap may be constructed of elastic whereby, when a beverage container is inserted into sleeve 10, the container may be pushed downwardly into the orientation shown in FIG. 6. In this orientation, the insulated beverage container may thus be deposited on a flat surface. It should be noted that, because strap 38 covers only a portion of the bottom as best shown in FIGS. 4 and 5, if any of the liquid of the beverage container spills, it will run downwardly out of sleeve 10.

A belt loop 40 is provided as best seen in FIGS. 2, 3 and 9. The belt loop includes a snap, including portions 42 and 44, whereby the belt loop may be loosened prior to attachment of the device to a belt after which the snap is reengaged in the position shown in FIG. 2. It should be noted that the material from which the device is constructed is preferably resilient whereby good contact is provided between the sleeve 10 and the beverage container to provide efficient insulation. It should also be noted that various types of insulating materials could be used for the insulating device such as textile, foam or plastic materials and the like.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A device for insulating a beverage container comprising:

a flexible insulating sleeve adapted to receive a beverage container therein;

a flexible cover for covering one end aperture of said sleeve, said cover having one end thereof secured to said sleeve;

first fastening means operatively associated with said sleeve and the other end of said cover whereby said cover may be secured over said first aperture; and second fastening means operatively associated with said sleeve and the other end of said cover whereby said cover may be secured to said sleeve to form a handle.

2. The device as set forth in claim 1 including strap means operably associated with the second end aperture of said sleeve for preventing a beverage container from passing through said second aperture while permitting liquid to pass through said second aperture.

3. The device as set forth in claim 1 wherein said cover comprises a flexible sleeve and forms a pocket, said cover including a third fastening means whereby said opening in said pocket may be secured shut.

4. The device as set forth in claim 1 including a loop secured to said sleeve for attaching said device to a belt.

5. A device for insulating a beverage container comprising:

a flexible resilient insulating sleeve adapted to receive a beverage container therein;

strap means operatively associated with a first end aperture of said sleeve for preventing a beverage container from passing through said first end aperture while permitting liquid to pass through said first aperture;

a flexible cover for covering the other end aperture of said sleeve, said cover having one end thereof secured to said sleeve, said cover comprising a flexible sleeve and forming a pocket, the other end of said cover including a first fastening means whereby said pocket may be secured shut;

a second fastening means operatively associated with the other end of said cover and said sleeve for securing said cover over said other sleeve aperture; and said cover including a third fastening means operatively associated with the other e nd of said cover and said sleeve where by said cover may be secured to said sleeve to form a handle.

6. The device according to claim 5 including a loop secured to said sleeve for attaching said device to a belt.

7. The device according to claim 5 wherein said first, second and third fastening means comprise strips of hook and loop material.

8. The device according to claim 1 wherein said first and second fastening means comprise strips of hook and loop material.

* * * * *